US008088860B2

(12) United States Patent
Hladik et al.

(10) Patent No.: US 8,088,860 B2
(45) Date of Patent: Jan. 3, 2012

(54) PAPER WITH PHOTO-FEEL BACKCOAT

(75) Inventors: Molly L. Hladik, San Diego, CA (US); Richard J. McManus, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 709 days.

(21) Appl. No.: 11/062,482

(22) Filed: Feb. 23, 2005

(65) Prior Publication Data

US 2006/0093796 A1 May 4, 2006

Related U.S. Application Data

(60) Provisional application No. 60/622,935, filed on Oct. 29, 2004.

(51) Int. Cl.

| | |
|---|---|
| ***B44C 1/17*** | (2006.01) |
| ***D21H 19/42*** | (2006.01) |
| ***D21H 19/84*** | (2006.01) |
| ***D21H 21/52*** | (2006.01) |
| ***B41M 5/00*** | (2006.01) |

(52) U.S. Cl. ..... 524/503; 524/528; 524/570; 524/585; 524/848; 428/195.1

(58) Field of Classification Search ..... 524/503, 524/528, 570, 585, 848; 428/195.1
See application file for complete search history.

(56) References Cited

U.S. PATENT DOCUMENTS

| | | | | |
|---|---|---|---|---|
| 3,664,912 | A | 5/1972 | Olson | |
| 3,791,856 | A | 2/1974 | Duling et al. | |
| 4,554,566 | A | 11/1985 | Yoneda et al. | |
| 4,898,849 | A | 2/1990 | Kang | |
| 5,049,595 | A | 9/1991 | Dethlefs et al. | |
| 5,141,914 | A | 8/1992 | Kang | |
| 5,501,902 | A | 3/1996 | Kronzer | |
| 6,284,034 | B1 | 9/2001 | Hiorns et al. | |
| 6,326,415 | B1 | 12/2001 | Miklasiewicz et al. | |
| 6,420,016 | B1 | 7/2002 | Peternell et al. | |
| 6,471,811 | B1 | 10/2002 | DeBoer | |
| 2003/0040558 | A1 * | 2/2003 | Kerr et al. | 524/2 |

FOREIGN PATENT DOCUMENTS

| | | |
|---|---|---|
| EP | 1 331 103 A | 7/2003 |
| JP | S61-280983 | 12/1986 |
| JP | 11-131389 | 5/1995 |
| JP | H9-66663 | 3/1997 |
| JP | 1997-123623 | 5/1997 |
| JP | 1999-301106 | 11/1999 |
| JP | 2002-264481 | 2/2002 |
| JP | 2002-169321 | 6/2002 |
| JP | 2003-211838 | 7/2003 |

* cited by examiner

*Primary Examiner* — Kelechi Egwim

(57) ABSTRACT

A photo-feel coating for application to a surface of paper which is opposite that configured to receive printing, includes a binder; and polyethylene particles having first and second predetermined sizes.

15 Claims, 3 Drawing Sheets

PAPER WITH PHOTO-FEEL BACKCOAT

BACKGROUND OF THE INVENTION

1. Field of the Invention

The present invention relates to a paper which is provided with a coating on a surface opposite to that which receives printing thereon and which provides a photobase feel to the paper.

2. Description of the Related Art

Paper which exhibits a photobase feeling is inherently expensive due to the procedures/materials required to produce the same. For example, the process of extruding polyethylene onto paper sheet requires specialized equipment which is not widely available and normally not available in the mills in which the paper is initially produced. Thus, the cost of such paper is increased not only the need for specialized extrusion equipment but the need to move the paper from the point of manufacture to another site for the coating operation.

A simpler, less expensive technique for producing such paper is therefore necessary.

BRIEF DESCRIPTION OF THE DRAWINGS

The various aspects and features of this invention will become more clearly appreciated as a detailed description of the preferred embodiments is given with reference to the appended drawings wherein.

DETAILED DESCRIPTION OF THE EXEMPLARY EMBODIMENTS

Figure 1:
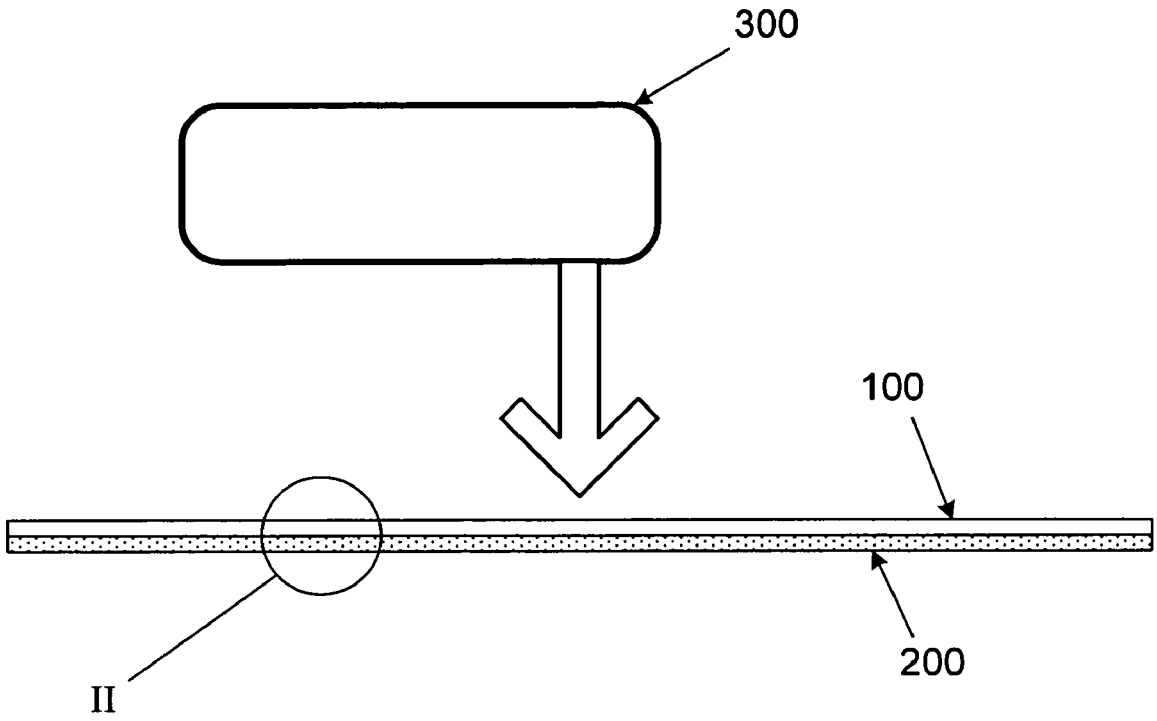
FIG. 1 is a schematic side view of an embodiment of the invention.

In an embodiment of the invention, a sheet of paper or basestock 100, which can be either untreated or treated, is coated with a "photo feel" layer 200 comprising one or more binders and polyethylene particles. This photo feel coating 200 is provided on a surface 102 of the paper which is opposite the printing surface 101 on which printing is carried out.

Figure 2:
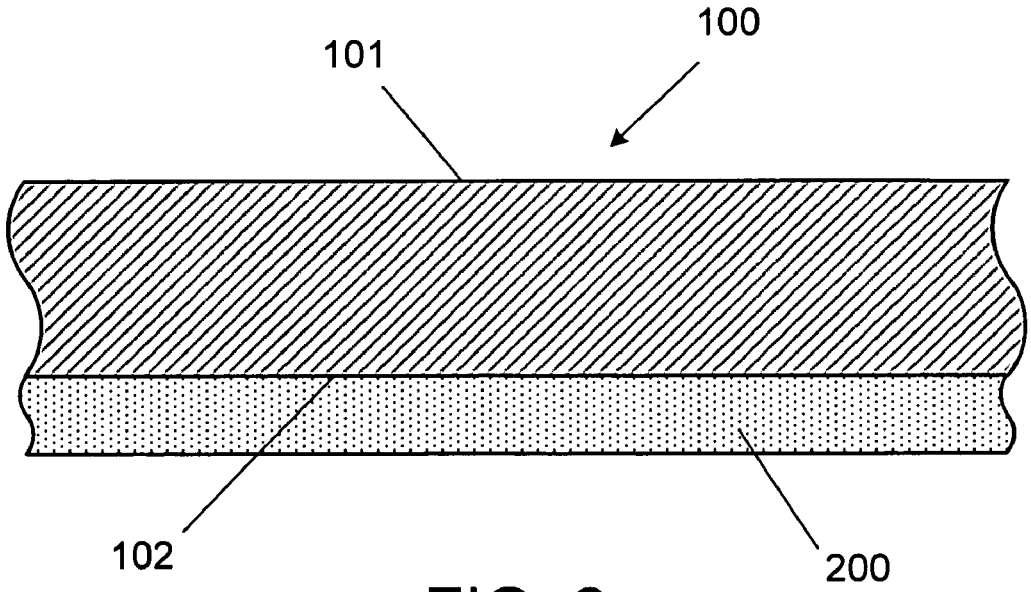
FIG. 2 is an enlarged view of the portion of the coated sheet enclosed in circle II of FIG. 1 wherein the sheet comprises untreated basestock.
Figure 3:
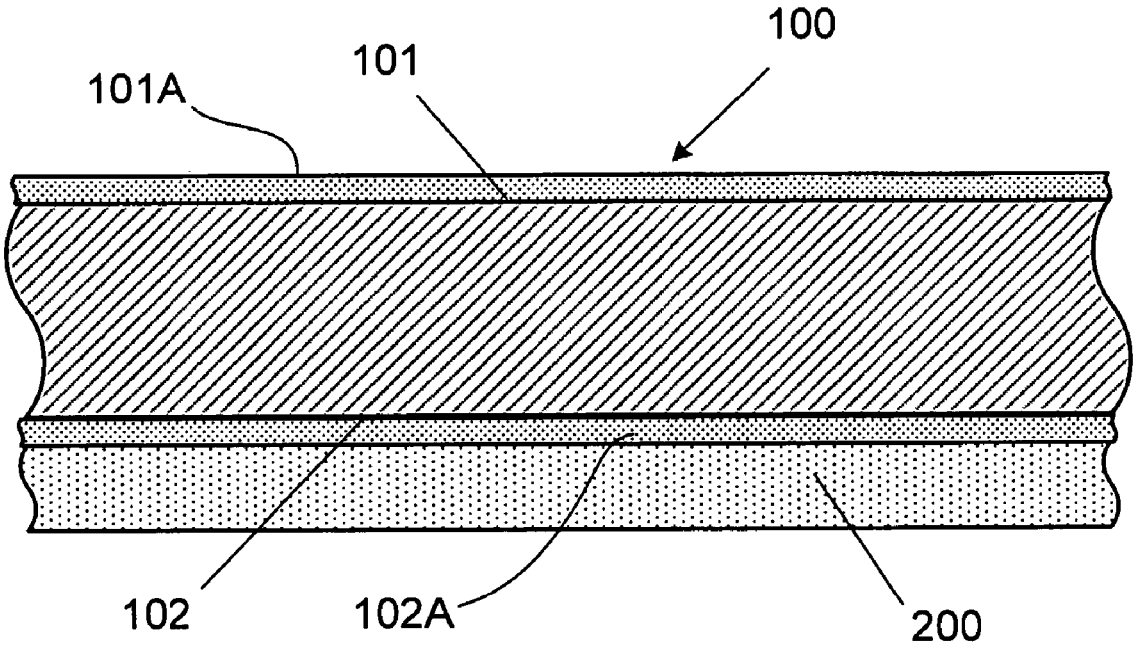
FIG. 3 is an enlarged view of the portion of the coated sheet enclosed in circle II of FIG. 1 wherein the sheet comprises treated basestock.
Figure 4:
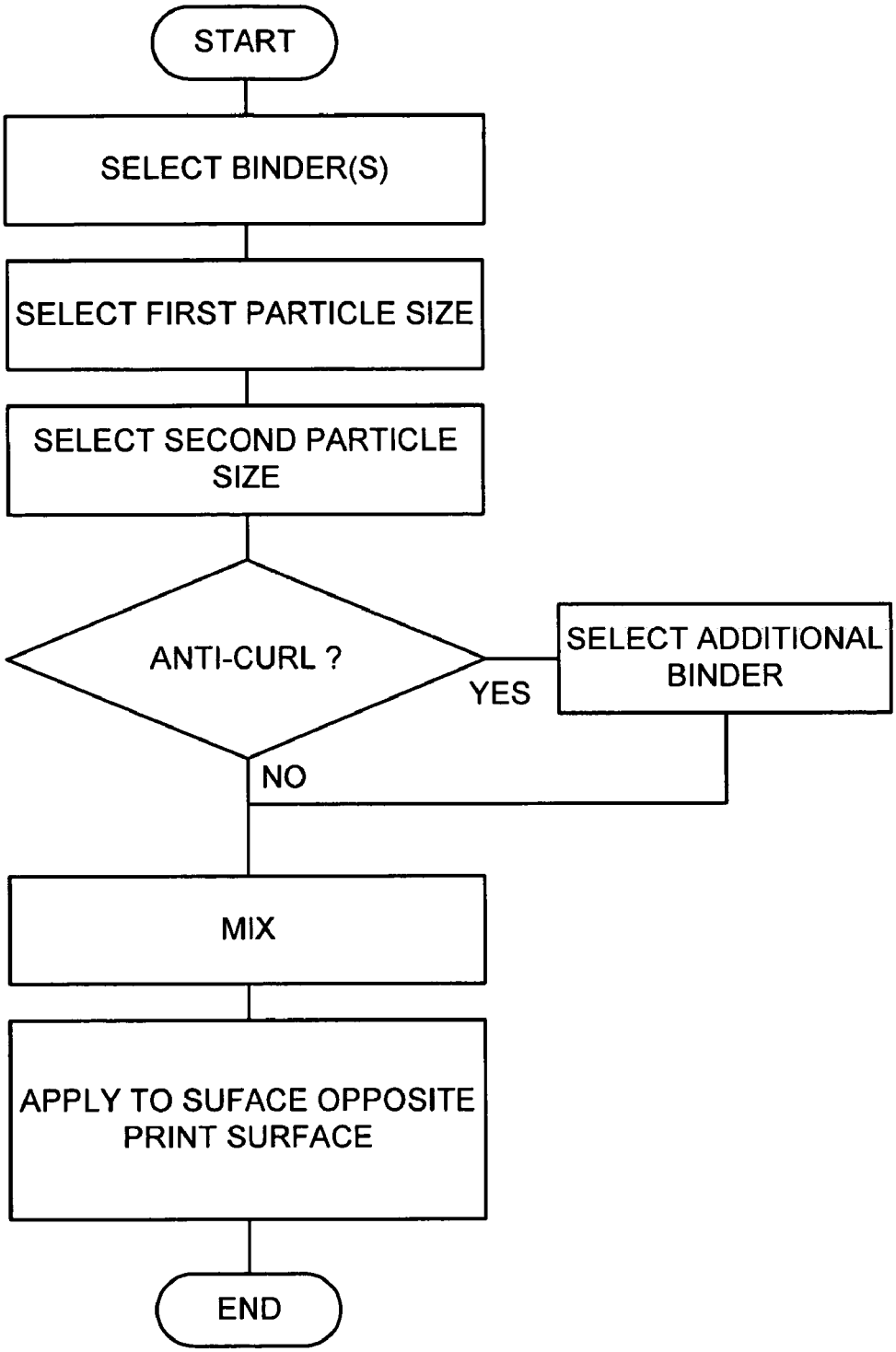
FIG. 4 is a flow chart depicting the steps which are carried out in accordance with one embodiment of the invention.

In the case of untreated basestock, the photo feel coating 200 is applied directly to the basestock in the manner shown in FIG. 2. In the case of treated basestock, wherein both sides are treated via the application of a print enhancing offset coating comprised of, but not limited to clays, grounded calcium carbonate, precipitated calcium carbonate, barium sulfate, titanium dioxide, silica, aluminum trihydrate, aluminum oxide, boehmite, and combinations thereof, the photo feel coating 200 is applied to the print enhacing offset coating 102A in the manner shown in FIG. 3.

The coating technique via which the photo feel coating is applied can, with the exception of extrusion, be selected from any suitable commercially available technique such as curtain coating, rod coating or slot coating. However, embodiments of the invention are not limited to these arrangements and gravure coating, reverse roll coating, knife over roll coating, for example, are not excluded.

The thickness of the coating can be varied between about 3 and about 50 gsm (grams per square meter). Usually coatings of about 5-25 gsm would be adequate, however this thickness can be varied depending upon the application and the paper that is used.

The paper or basestock to which the coating can be applied can be selected from commercially available stock such as "Galerie one gloss" and "Galerie one silk" produced by M-real of Kangus Finland, and # Savvy and # Influence by International Paper. The embodiments of the invention are, of course not limited to these selections and can be applied to different substrates (paper) as appropriate.

In FIG. 1 a printing arrangement 300 is schematically depicted printing onto the printing surface 101. This printing arrangement take the form of an inkjet printer, but is not limited thereto. For example, the printing arrangement can take the form of electrographic print, gravure, etc.

In one embodiment of the invention, the paper 100 can have the printing surface 101 coated with a layer or layers of material which facilitate ink jet printing. However, the embodiments of the invention are not limited to this type of treatment and can include treatment with calcium carbonate or silica, clay, aluminum oxide, aluminum trihydrates, titanium dioxide, aluminum silicates, etc. or the like.

The coating or layer 200 can comprise a single binder such as latex acrylic in which polyethylene particles are dispersed. In accordance with one embodiment of the invention, these polyethylene particles have at least two different sizes. A first group of particles can have a diameter in the range of about 25-200 nanometers while a second group can have a diameter in the range of about 1-6 microns. In accordance with one embodiment, a more preferred particle sizes range for the first particles is about 30-70 nm and a more preferred particle size for the second particle is about 3-5 microns.

The above mentioned binder can be selected from but not limited to styrene, styrene-acrylic, styrene-butadiene, acrylic, polyvinyl acetate, etc. It is also within the scope of the present invention to use a mixture of the just mentioned binders.

In a further embodiment of the invention an anti-curl agent can be introduced into the coating. This anti-curl agent can be a binder which can be selected from, but inot limited to polyvinyl alcohol, gelatin, starches, cellulose, modified cellulose, etc.

The combination of the large and small particles contributes to the smooth photo feel of the backchat which provides the photobase characteristics. The use of similar sized particles does not provide the desired feel, and, while it has not been positively determined, it is suspected that the smaller particles tend to fill in the gaps between the larger particles and provide a smoothing effect which leads to the desired feel of the backcoat.

EXAMPLES

Example #1

| | |
|---|---|
| 100 parts of binder # 1 | Acrylic Latex (Rhoplex GL618) |
| 10 parts of binder # 2 | Polyvinyl Alcohol (Mowiol 20-98) |
| 40 parts of particle # 1 | Polyethylene particles 4 μm (Michem Guard 20) |
| 60 parts of particle # 2 | Polyethylene particles 50 nm (Michem Shield 251) |
| Paper: | coated basestock |
| Coat thickness: | 8 gsm |
| Feel | preferred |

Example # 2

| | |
|---|---|
| 100 parts of binder # 1 | Acrylic Latex (Rhoplex R-253) |
| 40 parts of particle # 1 | Polyethylene particles 7 μm (Michem Guard 60) |
| 60 parts of particle # 2 | Polyethylene particles 35 nm (Michem Emulsion 39235) |
| Paper: | uncoated basestock |
| Coat thickness: | 20 gsm |
| Feel | acceptable |

Example # 3

| | |
|---|---|
| 50 parts of binder #1 | Styren/butadiene Latex (Rovene 4021) |
| 40 parts of particle #1 | Teflon particles 4 μm (Michem Glide 5) |
| 60 parts of particle # 2 | Polypropylene particles 45 nm (Michem emulsion 43040) |
| Paper: | coated basestock |
| Coat thickness: | 3-5 gsm |
| Feel | acceptable |

It will be appreciated that, although the invention has been described with reference to only a limited number of embodiments, the various modifications and changes that can be implemented without departing from the scope of appended claims, will be, given the preceding disclosure, readily apparent to those skilled in the art to which the present invention pertains or mostly pertains.

What is claimed is:

1. A photo-feel coating, comprising:

a binder; and polyethylene particles having first and second predetermined size, wherein the first predetermined size of the polyethylene particles is from about 25 to about 200 nanometers in diameter and the second predetermined size of the polyethylene particles is from about 1 to about 6 microns in diameter;

wherein the polyethylene particles having the first and second predetermined sizes are dispersed such that for about every 10 polyethylene particles having the first and second predetermined size, there are no more than about 6 polyethylene particles having the first predetermined size and no less than about 4 polyethylene particles having the second predetermined size;

and wherein for the about every 10 polyethylene particles dispersed in the coating, the particles having the first predetermined size predominate in number over the particles having the second predetermined size;

the photo-feel coating being configured for application to a surface of paper that is opposed to a paper surface configured to receive printing.

2. A photo-feel coating as set forth in claim 1, wherein the first predetermined size for the first particles is about 30-70 nm and the second predetermined size for the second particles is about 3-5 microns.

3. A photo-feel coating as set forth in claim 1, wherein the binder is selected from the group consisting of at least one of: styrene, styrene-acrylic, styrene-butadiene, acrylic, and polyvinyl acetate.

4. A photo-feel coating as set forth in claim 1, wherein the binder is an acrylic based binder.

5. A photo-feel coating as set forth in claim 1, further comprising a second binder, the second binder being added to provide a predetermined characteristic.

6. A photo-feel coating as set forth in claim 1, wherein the coating is configured to provide curl attenuation when applied to the surface of paper.

7. A photo-feel coating as set forth in claim 5, wherein the second binder is selected from the group comprising polyvinyl alcohol, gelatin, starches, cellulose, and modified cellulose.

8. A photo-feel coating as set forth in claim 1, wherein the binder is polyvinyl alcohol.

9. A photo-feel coating as set forth in claim 1, wherein the polyethylene particles having the first and second predetermined sizes are dispersed such that there are about 6 polyethylene particles having the first predetermined size for about every 4 polyethylene particles having the second predetermined size.

10. An article of manufacture, comprising:

a sheet of paper having a first and second surface, the second surface having a coating according to claim 1.

11. An article of manufacture, comprising:

a sheet of paper having a first and second surface, the first surface being configured to receive printing thereon, the second surface having a coating according to claim 1.

12. An article of manufacture, comprising:

a sheet of paper having a first and second surface, the first surface having printing thereon, the second surface having a coating according to claim 1.

13. An article of manufacture, comprising:

a sheet of paper having a first and second surface, the second surface having a coating according to claim 1, wherein the coating has a smooth surface having a photo base texture.

14. An article of manufacture, comprising:

a sheet of paper having a first and second surface, the second surface having a coating according to claim 1, wherein the coating has a thickness in the range of about 3 to about 5 gsm.

15. An article of manufacture, comprising:

a sheet of paper having a first and second surface, the second surface having a coating according to claim 1, wherein the paper is a cellulose based paper.

* * * * *

UNITED STATES PATENT AND TRADEMARK OFFICE

CERTIFICATE OF CORRECTION

PATENT NO. : 8,088,860 B2
APPLICATION NO. : 11/062482
DATED : January 3, 2012
INVENTOR(S) : Molly L. Hladik et al.

It is certified that error appears in the above-identified patent and that said Letters Patent is hereby corrected as shown below:

In column 4, line 49, in Claim 14, delete "5 gsm." and insert -- 50 gsm. --, therefor.

Signed and Sealed this
Twenty-third Day of October, 2012

David J. Kappos

David J. Kappos
*Director of the United States Patent and Trademark Office*